US008565643B2

(12) United States Patent
Kim et al.

(10) Patent No.: US 8,565,643 B2
(45) Date of Patent: Oct. 22, 2013

(54) SEPARATABLE DEVELOPING UNIT AND IMAGE FORMING APPARATUS HAVING THE SAME

(75) Inventors: Dae-ho Kim, Uiwang-si (KR); Sung-joo Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 176 days.

(21) Appl. No.: 13/032,154

(22) Filed: Feb. 22, 2011

(65) Prior Publication Data

US 2011/0274462 A1 Nov. 10, 2011

(30) Foreign Application Priority Data

May 10, 2010 (KR) ..... 2010-0043467

(51) Int. Cl.
*G03G 15/04* (2006.01)

(52) U.S. Cl.
USPC ..... 399/119; 399/110

(58) Field of Classification Search
USPC ..... 399/119, 110
See application file for complete search history.

(56) References Cited

U.S. PATENT DOCUMENTS

| | | | | |
|---|---|---|---|---|
| 4,583,832 | A * | 4/1986 | Kasamura et al. | 399/119 |
| 5,175,588 | A * | 12/1992 | Katagata | 399/106 |
| 5,812,910 | A * | 9/1998 | Kim | 399/111 |
| 7,321,739 | B1 * | 1/2008 | Dawson et al. | 399/90 |
| 2006/0045567 | A1 * | 3/2006 | Ahn et al. | 399/111 |
| 2006/0140681 | A1 * | 6/2006 | Yamane | 399/258 |

FOREIGN PATENT DOCUMENTS

JP 2000-147980 5/2000

* cited by examiner

*Primary Examiner* — Clayton E Laballe
*Assistant Examiner* — Jas Sanghera
(74) *Attorney, Agent, or Firm* — Staas & Halsey LLP

(57) ABSTRACT

A developing unit and an image forming apparatus having the same are provided. The image forming apparatus includes: an image forming apparatus body, a developing unit which is removably mounted in the image forming apparatus body to develop an image formed on a printing medium, and which includes a handle, and a toner supply unit which is removably mounted in the image forming apparatus body to supply toner to the developing unit. The handle is movable between a first position in which the handle is pressed by the toner supply unit when the toner supply unit is mounted in the image forming apparatus body, thereby yielding part of a occupying space to the toner supply unit, and a second position in which the occupying space yielded to the toner supply unit is restored when the handle is free from a pressure of the toner supply unit.

19 Claims, 11 Drawing Sheets

SEPARATABLE DEVELOPING UNIT AND IMAGE FORMING APPARATUS HAVING THE SAME

CROSS-REFERENCE TO RELATED APPLICATIONS

This application claims priority from Korean Patent Application No. 10-2010-0043467, filed on May 10, 2010, in the Korean Intellectual Property Office, the disclosure of which is incorporated herein by reference in its entirety.

BACKGROUND

1. Field

The at least one embodiment relates to a developing unit and an image forming apparatus having the same, and more particularly, to a developing unit of a two-piece type which is separated from a toner supply unit (toner receptacle) and an image forming apparatus having the same.

2. Description of the Related Art

An image forming apparatus adopting electrophotography technology generally performs a printing operation by forming an electrostatic latent image on an image carrier (referred to as a photosensitive drum or a photosensitive body), developing the electrostatic latent image into a toner image, and transferring the toner image to a printing medium such as printing paper. Representative examples of such an image forming apparatus are laser printers, copiers, and facsimile machines.

The image forming apparatus includes a body to stack/supply a printing medium and drive various rollers, and a developing unit (imaging unit) mounted in the body to form an image. The developing unit may be classified into a one-piece type and a two-piece type according to lifespan, speed, developing method, and system layout. In the case of a developing unit of a one-piece type, a toner supply unit (commonly called a toner receptacle) is integrally formed with the developing unit. On the other hand, in the case of a developing unit of a two-piece type, a toner supply unit is separated from the developing unit and is provided as a separate element. In the two-piece type, the toner supply unit and the developing unit may be called "a toner cartridge" and a "developing cartridge", respectively. Hereinafter, the developing unit is referred to as, but not limited to, a developing unit of a two-piece type, which is separated from a toner supply unit.

The developing unit and the toner supply unit of the two-piece type are removably mounted in the body of the image forming apparatus separately. Therefore, the developing unit and the toner supply unit are provided with handles for the sake of a user's convenience when they are mounted or carried by a user. In general, the handle of the developing unit is formed on an outer surface of an upper portion of a developing unit body, and the toner supply unit is disposed substantially adjacent to an upper portion of the developing unit. Therefore, the toner supply unit may be hindered from being disposed closer to the developing unit due to the presence of the handle of the developing unit.

In this case, the image forming apparatus body including the developing unit and the toner supply unit should guarantee a larger space for the handle of the developing unit. However, enlarging the space for the handle in the image forming apparatus body goes against a trend toward miniaturization of the image forming apparatus and thus is not preferable.

SUMMARY

Accordingly, it is an aspect of at least one embodiment to provide a developing unit having a handle capable of contributing to miniaturization of an image forming apparatus, and an image forming apparatus having the same.

The foregoing and/or other aspects are achieved by providing a developing unit of an image forming apparatus which includes a toner supply unit and a developing unit as separate members, wherein the developing unit includes a developing unit body and a handle formed on the developing unit body, wherein the handle is movable between a first position in which the handle is pressed by the toner supply unit when the toner supply unit is mounted in an image forming apparatus body, thereby yielding part of an occupying space to the toner supply unit, and a second position in which the occupying space yielded to the toner supply unit is restored when the handle is free from a pressure of the toner supply unit.

Also, the foregoing and/or other aspects are achieved by providing an image forming apparatus, including: an image forming apparatus body, a developing unit which is removably mounted in the image forming apparatus body to develop an image formed on a printing medium, and which includes a handle, and a toner supply unit which is removably mounted in the image forming apparatus body to supply toner to the developing unit, wherein the handle is movable between a first position in which the handle is pressed by the toner supply unit when the toner supply unit is mounted in the image forming apparatus body, thereby yielding part of a occupying space to the toner supply unit, and a second position in which the occupying space yielded to the toner supply unit is restored when the handle is free from a pressure of the toner supply unit.

The handle may be pivotable between the first position and the second position.

The developing unit may further include an elastic member which provides an elastic force to the handle to allow the handle to pivot to the second position when the handle is free from the pressure of the toner supply unit.

The developing unit may further include at least one pivoting restriction unit which restricts a pivotal movement of the handle at the first position and the second position.

The pivoting restriction unit may include a first pivoting restriction part, which includes a first stopping surface formed on the handle and a second stopping surface formed adjacent to the first stopping surface, and the pivotal movement of the handle may be restricted at the first position due to contact between the first stopping surface and an outer surface of the developing unit body, and at the second position due to contact between the second stopping surface and the outer surface of the developing unit body.

The handle may include a pair of coupling parts pivotably coupled with the developing unit body, and a connecting part to connect the pair of coupling parts, and the first stopping surface and the second stopping surface are formed on the connecting parts, respectively.

The pivoting restriction unit may include a second pivoting restriction part, and the second pivoting restriction part may include a stopping recess formed on the handle and having a third stopping surface and a fourth stopping surface, and a locking protrusion protruding from the developing unit body so as to be inserted into the stopping recess and having a first locking surface and a second locking surface, and the pivotal movement of the handle may be restricted at the first position due to contact between the third stopping surface and the first locking surface, and at the second position due to contact between the fourth stopping surface and the second locking surface.

The handle may include a pair of coupling parts pivotably coupled with the developing unit body, and a connecting part to connect the pair of coupling parts, and the stopping recess may be formed on each of the pair of coupling parts.

The foregoing and/or other aspects are achieved by providing an image forming apparatus, including: an image forming apparatus body; a developing unit body mounted in the image forming apparatus body; a handle mounted to the developing unit body and movable from a first position to a second position; a removable toner supply unit removably mounted in the image forming apparatus body and pressing the handle from the first position to the second position when the removable toner supply unit is mounted in the image forming apparatus body.

The handle may include a stopping surface, the handle being restricted in the first position when the stopping surface abuts against the developing unit body.

The image forming apparatus may further include a mount connected between the developing unit body and the handle, the handle including a recess and being restricted in the first position when a surface of the mount contacts a surface of the recess.

BRIEF DESCRIPTION OF THE DRAWINGS

The above and/or other aspects will become more apparent by describing in detail the exemplary embodiments, with reference to the accompanying drawings in which.

DETAILED DESCRIPTION

Figure 1:
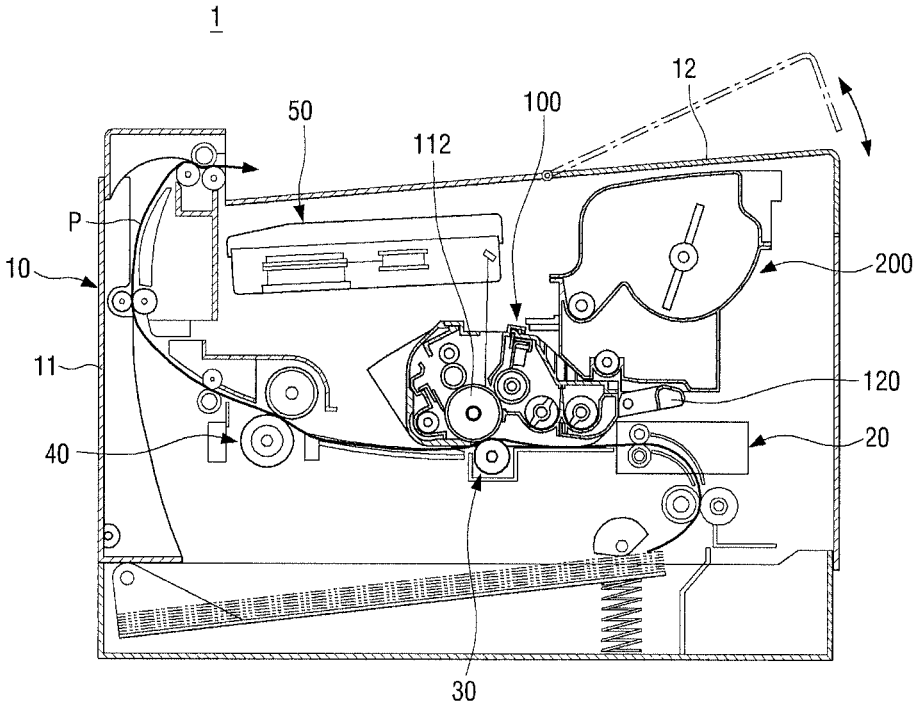
FIG. 1 is a cross-section view schematically illustrating an image forming apparatus according to at least one embodiment.

Reference will now be made in detail to at least one example embodiment, examples of which are illustrated in the accompanying drawings, wherein like reference numerals refer to the like elements throughout. At least one example embodiment is described below to explain the present disclosure by referring to the figures.

FIG. 1 is a view schematically illustrating an image forming apparatus according to at least one exemplary embodiment.

Referring to FIG. 1, an image forming apparatus 1 is illustrated as a laser printer. A developing unit 100 to develop an image on a printing medium and a toner supply unit 200 to supply toner to the developing unit 100 are mounted in a body 10 of the image forming apparatus 1. Besides these, the body 10 of the image forming apparatus 1 contains an alignment unit 20 to align picked-up printing media, a transfer unit 30 to transfer a developer image to the printing medium, a fusing unit 40 to fuse the developer image onto the printing medium, a laser scanning unit 50 to scan an image carrier 112 of the developing unit 100 with laser in order to form an electrostatic latent image, and diverse conveyance units to convey the printing medium (no reference numeral assigned).

A brief printing process advancing along a printing medium conveyance path P is as follows. A printing medium stacked on a lower portion of the body 10 is picked up and aligned by the alignment unit 20. The aligned printing medium receives a developer image from the image carrier 112 disposed in the developing unit 100 through the transfer unit 30 and then undergoes a fusing process of a developer at the fusing unit 40, and is then discharged to the outside of the body 10. The inner components of the image forming apparatus 1 and the printing process are merely examples and the present disclosure is not limited to the above-described process.

An openable and closable cover 12 is formed on an outer casing 11 of the body 10. A user may mount or dismount the developing unit 100 and the toner supply unit 200 with respect to the body 10 by opening the cover 12. In at least one exemplary embodiment, the developing unit 100 and the toner supply unit 200 are not integrated with each other and are separated from each other as separate elements. In other words, the developing unit 100 according to at least one embodiment is of a two-piece type.

As shown in FIG. 1, the developing unit 100 is disposed closer to the inside and a lower portion of the body 10 in comparison with the toner supply unit 200. Accordingly, the developing unit 100 is mounted in the body 10 of the image forming apparatus 1 ahead of the toner supply unit 200 and is dismounted from the body 10 following dismounting of the toner supply unit 200. A part of the toner supply unit 200 is seated on an upper portion of the developing unit 100 in the body 10 of the image forming apparatus 1.

The developing unit 100 has a handle 120 formed on one side thereof. The user can easily mount and dismount the developing unit 100 on and from the body 10 with the handle 120. The handle 120 of the developing unit 100 will be explained in detail below with reference to FIGS. 2 to 6B.

Figure 2:
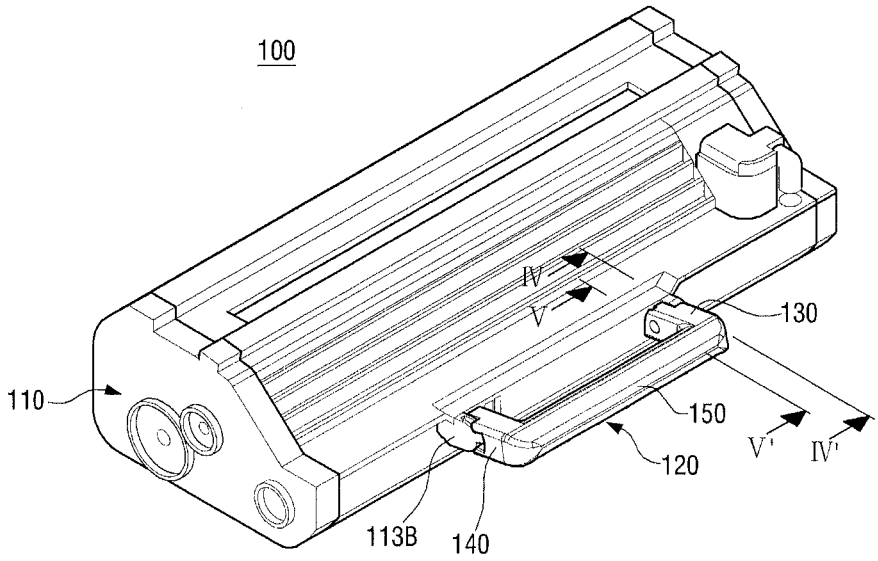
FIG. 2 is a perspective view illustrating a developing unit employed in the image forming apparatus of FIG. 1.
Figure 3:
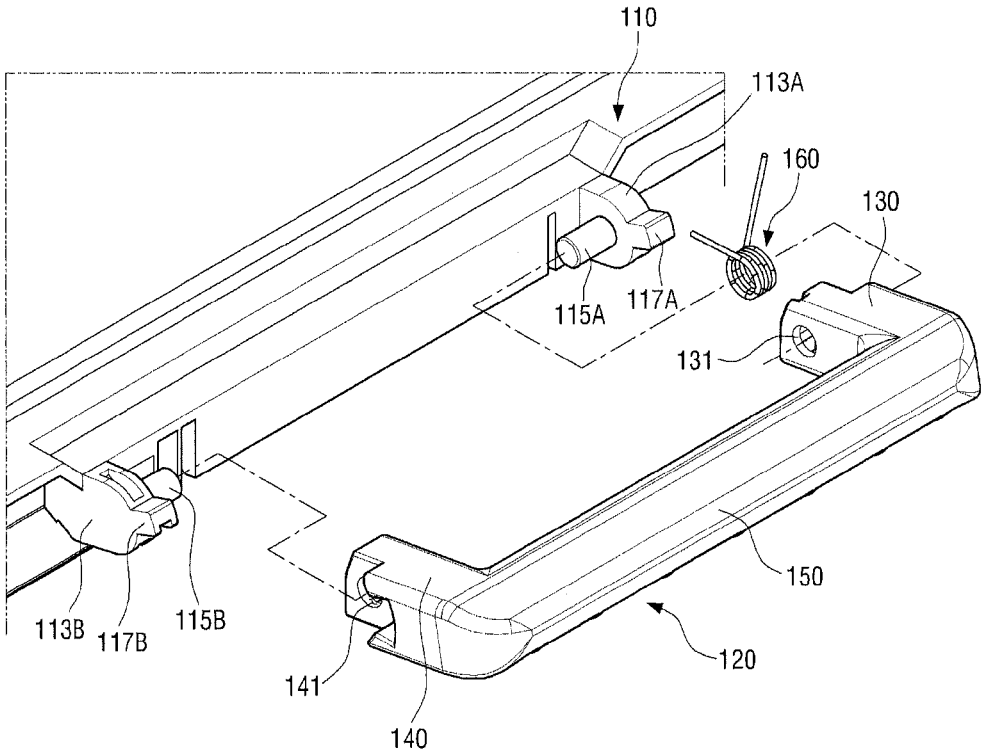
FIG. 3 is an enlarged perspective view illustrating the developing unit of FIG. 2 with a handle being separated.
Figure 4A:
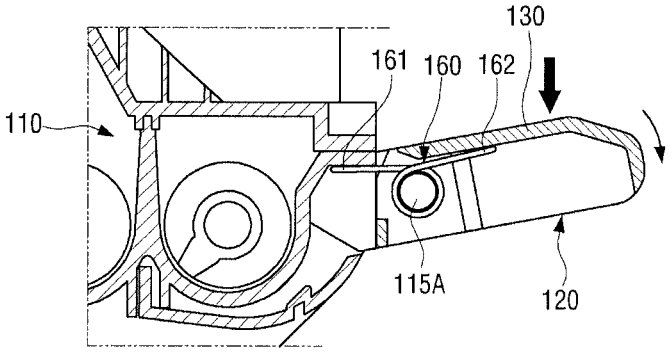
FIGS. 4A and 4B are cross-sectional views taken along lines IV-IV' of FIG. 2, illustrating the handle under the pressure of a toner supply unit and the handle free from the pressure of the toner supply unit, respectively.
Figure 4B:
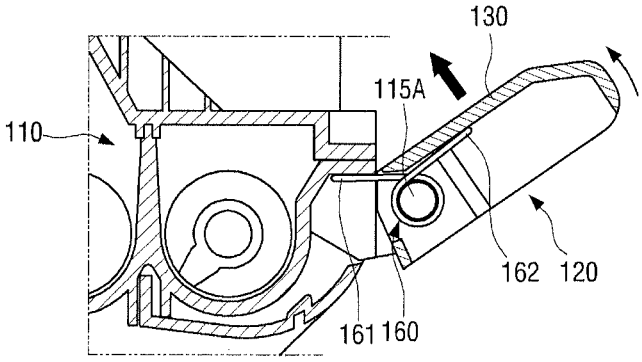

FIGS. 2 to 4B are referred to first. FIG. 2 is a perspective view illustrating the developing unit 100 provided in the image forming apparatus 1 of FIG. 1, FIG. 3 is an enlarged perspective view illustrating the developing unit 100 of FIG. 2 with the handle being separated, and FIGS. 4A and 4B are cross-sectional views of the developing unit 100 taken along line IV-IV' of FIG. 2, illustrating the handle under the pressure of the toner supply unit and the handle free from the pressure of the toner supply unit, respectively.

Referring to FIGS. 2 and 3, a pair of mounts 113A, 113B protrudes outwards from a developing unit body 110 in order to mount the handle 120 on the developing unit body 110. A pair of pivotal shafts 115A, 115B are disposed in the mounts 113A, 113B, facing each other. The handle 120 includes a pair of coupling parts 130, 140 and a connecting part 150 to connect the coupling parts 130, 140. Coupling holes 131, 141 penetrate through the coupling parts 130, 140, respectively. The handle 120 is pivotably disposed on the developing unit body 110 by inserting the pivotal shafts 115A, 115B of the body 110 into the coupling holes 131, 141 of the handle 120.

Referring to FIG. 3 and FIGS. 4A and 4B, the handle 120 includes an elastic member 160 to allow the handle 120 to pivot to an initial position when the handle 120 is free from the pressure of the toner supply unit 200. The elastic member 160 may be a torsion spring, but is not limited thereto and may be any type of flexible device to cause the handle to pivot. As shown in FIG. 4A, the elastic member 160 is received in the coupling part 130 of the handle 120 with the pivotal shaft 115A being inserted thereto. One end 161 of the elastic member 160 is supported by the developing unit body 110 and the other end 162 is supported by an inner surface of the coupling part 130. Therefore, the elastic member 160 provides an elastic force of a counter-clockwise direction to the handle 120. When the toner supply unit 200 is mounted in the image forming apparatus 1 as shown in FIG. 4A, the handle 120 pivots in a clockwise direction due to the pressure of the toner supply unit 200. When the toner supply unit 200 is dismounted from the image forming apparatus 1 as shown in FIG. 4B, the handle 120 pivots in the counter-clockwise direction due to the elastic force of the elastic member 160.

The handle 120 stops pivoting in the clockwise or counter-clockwise direction at a fixed position. In other words, when the pressure of the toner supply unit 200 is applied, the handle 120 pivots in the clockwise direction and stops pivoting at a "first position" as shown in FIG. 4A. When being free from the pressure of the toner supply unit 200, the handle 120 pivots in the counter clockwise direction and stops pivoting at a "second position" as shown in FIG. 4B. That is, the handle 120 pivots from the second position to the first position under the pressure of the toner supply unit 200 and returns to the second position from the first position when being free from the pressure.

The developing unit 100 includes a pivoting restriction unit (no reference numeral assigned) to restrict a pivotal movement of the handle 120. The pivoting restriction unit includes a first pivoting restriction part 170 and a second pivoting restriction part 190.

Figure 5A:
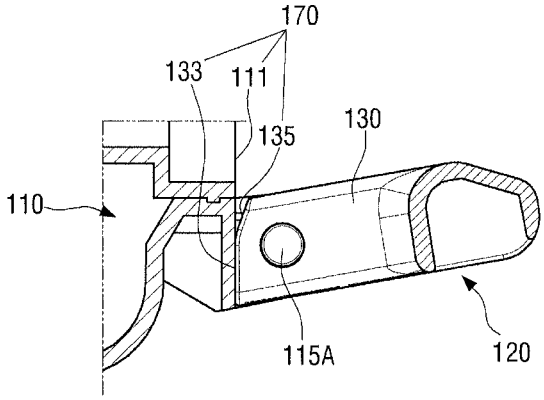
FIGS. 5A and 5B are cross-sectional views taken along lines V-V' of FIG. 2, illustrating the handle under the pressure of the toner supply unit and the handle free from the pressure of the toner supply unit, respectively.
Figure 5B:
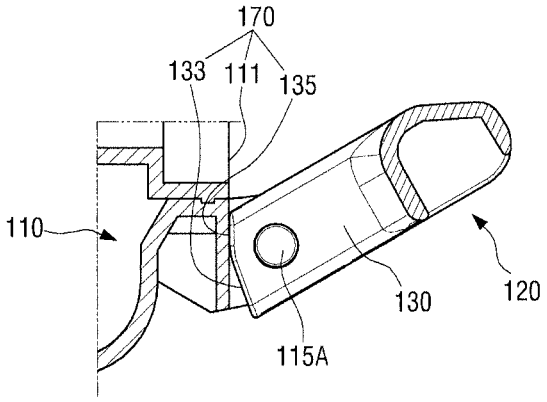

The first pivoting restriction part 170 will be explained with reference to FIGS. 5A and 5B. FIGS. 5A and 5B are cross-sectional views of the developing unit taken along lines V-V' of FIG. 2, illustrating the handle 120 under the pressure of the toner supply unit 200 and the handle 120 when being free from the pressure of the toner supply unit 200, respectively.

Referring to FIGS. 5A and 5B, the first pivoting restriction part 170 is formed by a first stopping surface 133 and a second stopping surface 135 formed on the handle 120, and an outer surface 111 of the developing unit body 110. In FIGS. 5A and 5B, the first stopping surface 133 and the second stopping surface 135 are formed on one coupling part 130, but the first stopping surface 133 and the second stopping surface 135 are formed on the other coupling part 140 likewise. As shown in FIG. 5A, the handle 120 pivoting under the pressure of the toner supply unit 200 stops pivoting at the first position due to contact between the first stopping surface 133 and the outer surface 111 of the developing unit body 110. Also, as shown in FIG. 5B, the handle 120 pivoting in the opposite direction due to the elastic force of the elastic member 160 when being free from the pressure of the toner supply unit 200 stops pivoting at the second position due to contact between the second stopping surface 135 and the outer surface 111 of the developing unit body 110. The second stopping surface 135 is angled relative to the first stopping surface 111 so that when the handle 120 is pressed, the second stopping surface 135 moves from a position at which the second stopping surface 135 abuts against the outer surface 111 of the developing unit body 110 to a position at which the second stopping surface 135 is spaced from the outer surface 111 of the developing unit body 110.

Figure 6A:
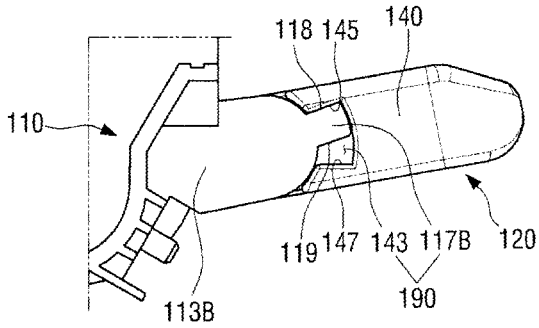
FIGS. 6A and 6B are side views of the handle formed on the developing unit, illustrating the handle under the pressure of the toner supply unit and the handle free from the pressure of the toner supply unit, respectively.
Figure 6B:
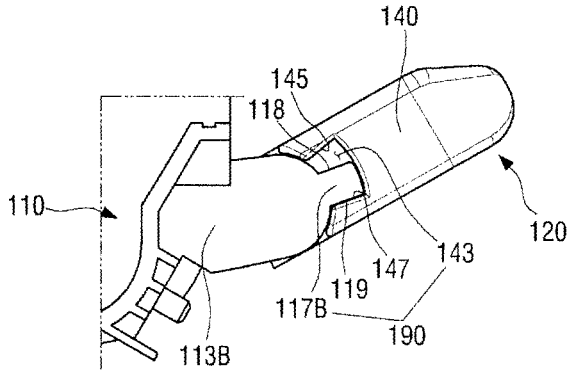

The second pivoting restriction part 190 will be described with reference to FIGS. 6A and 6B. FIGS. 6A and 6B are side views of the handle 120 provided on the developing unit 100, illustrating the handle 120 under the pressure of the toner supply unit 200 and the handle 120 when being free from the pressure of the toner supply unit 200, respectively.

Referring to FIG. 3 and FIGS. 6A and 6B, the second pivoting restriction part 190 includes a stopping recess 143 formed on the handle 120 and locking protrusions 117A, 117B formed on the developing unit body 110. The stopping recess 143 is formed on each of the two coupling parts 130, 140. The locking protrusions 117A, 117B are formed on the pair of mounts 113A, 113B of the developing unit body 110 (see FIG. 3), respectively. As shown in FIGS. 6A and 6B, the locking protrusion 117B is shaped so that the locking protrusion 117B can be inserted into the stopping recess 143. The stopping recess 143 includes a third stopping surface 145 and a fourth stopping surface 147, and the locking protrusion 117B includes a first locking surface 118 and a second locking surface 119.

Therefore, as shown in FIG. 6A, the handle 120 pivoting under the pressure of the toner supply unit 200 stops pivoting at the first position due to contact between the third stopping surface 145 and the first locking surface 118. As shown in FIG. 6B, the handle 120 pivoting in the opposite direction due to the elastic force of the elastic member 160 when being free from the pressure of the toner supply unit 200 stops pivoting at the second position due to contact between the fourth stopping surface 147 and the second locking surface 119.

As described above, the pivoting restriction unit of the developing unit 100 includes the first pivoting restriction part 170 and the second pivoting restriction part 190. However, since the first pivoting restriction part 170 and the second pivoting restriction part 190 perform the same function, the developing unit 100 may include either one of the first pivoting restriction part 170 and the second pivoting restriction part 190 in at least one embodiment.

Figure 7A:
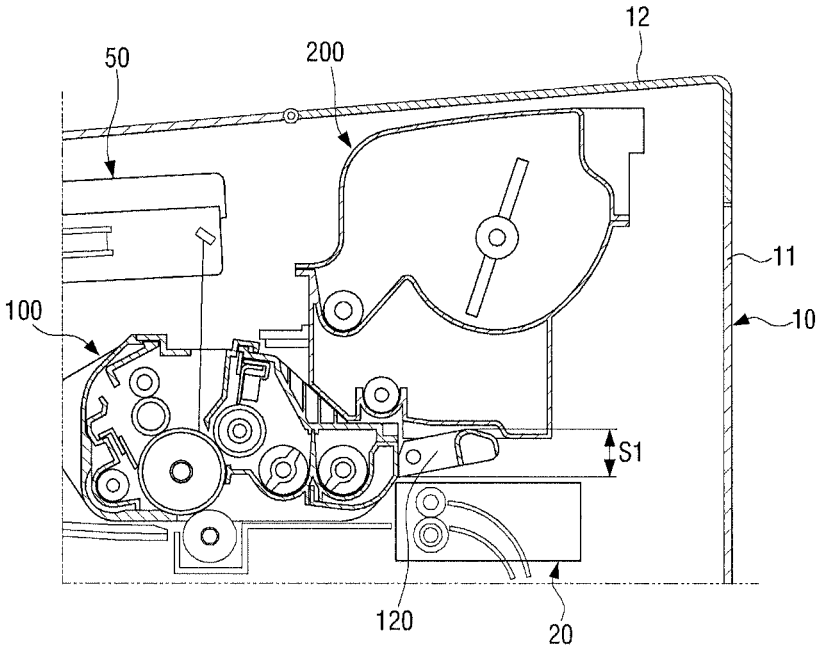
FIGS. 7A and 7B are schematic cross-sectional views to explain an operation of the handle additionally, illustrating the developing unit and the toner supply unit both of which are mounted in the image forming apparatus body, and the toner supply unit which is being dismounted from the image forming apparatus, respectively.
Figure 7B:
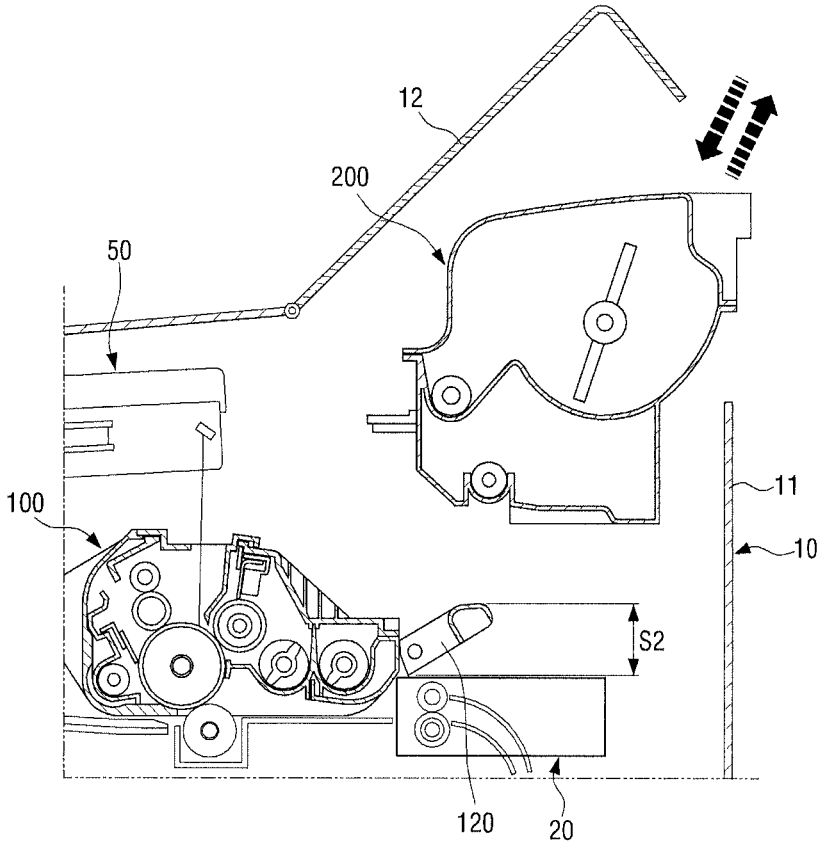

Hereinafter, the handle 120 provided on the developing unit 100 will be described in detail with reference to FIGS. 7A and 7B. FIGS. 7A and 7B are schematic cross-sectional views illustrating the image forming apparatus 1 in order to explain the handle 120 provided on the developing unit 100 of FIG. 2 additionally, FIG. 7A illustrates the image forming apparatus 1 in which both the developing unit 100 and the toner supply unit 200 are mounted in the body 10, and FIG. 7B illustrates the image forming apparatus 1 when the toner supply unit 200 is dismounted from the body 10.

As shown in FIG. 7A, when both the developing unit 100 and the toner supply unit 200 are mounted in the body 10, the handle 120 of the developing unit 100 is placed in the "first position" due to the pressure applied from the toner supply unit 200. The handle 120 placed in the first position occupies a space S1. On the other hand, when the toner supply unit 200 is dismounted from the body 10 as shown in FIG. 7B, the handle 120 of the developing unit 100 is placed in the "second position" due to the elastic force of the elastic member 160 (see FIG. 4). The handle 120 placed in the second position occupies a space S2.

The space S2 in the second position is larger than the space S1 in the first position as shown in FIGS. 7A and 7B. In particular, the handle 120 of the developing unit 100 in the first position (position in FIG. 7A) yields part of its own space corresponding to $\Delta S = S2 - S1$ to the toner supply unit 200. In other words, when the toner supply unit 200 is mounted in the body 10 of the image forming apparatus 1, the handle 120 of the developing unit 100 moves in one direction, thereby yielding part of its own space to the toner supply unit 200.

The toner supply unit 200 is able to be closer to the inside of the body 10 as much as the space yielded by the handle 120 of the developing unit 100. To this end, a necessary space in the body 10 can be reduced and accordingly a compact-sized image forming apparatus can be achieved.

Referring to FIGS. 7A and 7B more minutely, the alignment unit 20 described above is disposed under the handle 120 of the developing unit 100. If the elastic member 160 is not provided in the handle 120 of the developing unit 100, the handle 120 is always placed in the first position, as shown in FIG. 7A. In this case, since the alignment unit 20 is so close to the handle 120 that it is difficult for the user to grip the handle 120 easily. However, in this exemplary embodiment, since the handle 120 pivots to the second position when being free from the pressure of the toner supply unit 200 as shown in FIG. 7B due to the elastic member 160 (see FIG. 4), the user can easily grip the handle 120.

Although the image forming apparatus 1 in this exemplary embodiment is a laser printer, the technical idea of the present disclosure may be applied to any other type of image forming apparatuses, such as copiers and facsimile machines, that include the developing unit of the two-piece type.

As described above, when the toner supply unit 200 is mounted in the image forming apparatus body 10, the handle 120 of the developing unit 100 is moved in one direction due to the pressure of the toner supply unit 200, so that the space required to mount the toner supply unit 200 can be reduced, and accordingly the image forming apparatus 1 can be miniaturized. Also, when the toner supply unit 200 is dismounted from the image forming apparatus body 10, the handle 120 of the developing unit 100 automatically returns to the initial position so that a difficulty in griping the handle 120 due to the presence of other components disposed under the handle 120 can be solved.

Although at least one embodiment has been shown and described, the present disclosure is not limited to the described at least one example embodiment. Instead, it would be appreciated by those skilled in the art that changes may be made to the at least one example embodiment without departing from the principles and spirit of the disclosure, the scope of which is defined by the claims and their equivalents.

What is claimed is:

1. An image forming apparatus, comprising:

an image forming apparatus body;

a toner supply unit removably mounted in the image forming apparatus body to supply toner, a developing unit configured to receive toner from the toner supply unit and removably mounted in the image forming apparatus body to develop an image formed on a printing medium, and which includes a handle movable between a first position in which the handle is pressed by the toner supply unit when the toner supply unit is mounted in the image forming apparatus body and yielding part of an occupying space to the toner supply unit, and a second position in which the occupying space yielded to the toner supply unit is restored when the handle is free from a pressure of the toner supply unit.

2. The image forming apparatus according to claim 1, wherein the handle is pivotable between the first position and the second position.

3. The image forming apparatus according to claim 2, further comprising an elastic member providing an elastic force to the handle to allow the handle to pivot from the first position to the second position when the handle is free from the pressure of the toner supply unit.

4. The image forming apparatus according to claim 3, further comprising at least one pivoting restriction unit which restricts a pivotal movement of the handle at the first position and the second position.

5. The image forming apparatus according to claim 4, wherein the at least one pivoting restriction unit comprises a first pivoting restriction part which includes a first stopping surface formed on the handle and a second stopping surface formed adjacent to the first stopping surface, the pivotal movement of the handle being restricted at the first position due to contact between the first stopping surface and an outer surface of a body of the developing unit, and at the second position due to contact between the second stopping surface and the outer surface of the body of the developing unit.

6. The image forming apparatus according to claim 5, wherein the handle comprises a pair of coupling parts pivotably coupled with the body of the developing unit, and a connecting part to connect the pair of coupling parts, the first stopping surface and the second stopping surface being formed on the coupling parts, respectively.

7. The image forming apparatus according to claim 5, wherein the at least one pivoting restriction unit comprises a second pivoting restriction part including a stopping recess formed on the handle and having a third stopping surface and a fourth stopping surface, and a locking protrusion protruding from the body of the developing unit to be inserted into the stopping recess and having a first locking surface and a second locking surface, the pivotal movement of the handle being restricted at the first position due to contact between the third stopping surface and the first locking surface and at the second position due to contact between the fourth stopping surface and the second locking surface.

8. The image forming apparatus according to claim 7, wherein the handle comprises a pair of coupling parts pivotably coupled with the body of the developing unit, and a connecting part to connect the pair of coupling parts, the stopping recess being formed on each of the pair of coupling parts.

9. A developing unit of an image forming apparatus which includes a toner supply unit and a developing unit as separate members, the developing unit comprising:

a developing unit body; and a handle formed on the developing unit body, the handle being movable between a first position in which the handle is pressed by the toner supply unit when the toner supply unit is mounted in a body of the image forming apparatus and yielding part of an occupying space to the toner supply unit, and a second position in which the occupying space yielded to the toner supply unit is restored when the handle is free from a pressure of the toner supply unit.

10. The developing unit according to claim 9, wherein the handle is pivotable between the first position and the second position.

11. The developing unit according to claim 10, further comprising an elastic member which provides an elastic force to the handle to allow the handle to pivot to the second position when the handle is free from the pressure of the toner supply unit.

12. The developing unit according to claim 11, further comprising at least one pivoting restriction unit which restricts a pivotal movement of the handle at the first position and the second position.

13. The developing unit according to claim 12, wherein the at least one pivoting restriction unit comprises a first pivoting restriction part including a first stopping surface formed on the handle and a second stopping surface formed adjacent to the first stopping surface, the pivotal movement of the handle being restricted at the first position due to contact between the first stopping surface and an outer surface of the developing unit body, and at the second position due to contact between the second stopping surface and the outer surface of the developing unit body.

14. The developing unit according to claim 13, wherein the handle comprises a pair of coupling parts pivotably coupled with the developing unit body, and a connecting part to connect the pair of coupling parts, the first stopping surface and the second stopping surface being formed on the connecting parts, respectively.

15. The developing unit according to claim 13, wherein the at least one pivoting restriction unit comprises a second pivoting restriction part including a stopping recess formed on the handle and having a third stopping surface and a fourth stopping surface, and a locking protrusion protruding from the developing unit body to be inserted into the stopping recess and having a first locking surface and a second locking surface, the pivotal movement of the handle being restricted at the first position due to contact between the third stopping surface and the first locking surface, and at the second position due to contact between the fourth stopping surface and the second locking surface.

16. The developing unit according to claim 15, wherein the handle comprises a pair of coupling parts pivotably coupled with the developing unit body, and a connecting part to connect the pair of coupling parts, the stopping recess being formed on each of the pair of coupling parts.

17. An image forming apparatus, comprising:

an image forming apparatus body;

a developing unit body mounted in the image forming apparatus body;

a handle mounted to the developing unit body and movable from a first position to a second position;

a removable toner supply unit removably mounted in the image forming apparatus body and pressing the handle from the first position to the second position when the removable toner supply unit is mounted in the image forming apparatus body.

18. The image forming apparatus according to claim 17, wherein the handle includes a stopping surface, the handle being restricted in the first position when the stopping surface abuts against the developing unit body.

19. The image forming apparatus according to claim 17, further comprising a mount connected between the developing unit body and the handle, the handle including a recess and being restricted in the first position when a surface of the mount contacts a surface of the recess.

* * * * *